US005842091A

United States Patent [19]

Nakano

[11] Patent Number: 5,842,091

[45] Date of Patent: Nov. 24, 1998

[54] TONER SUPPLYING DEVICE FOR USE IN IMAGE FORMING APPARATUS THAT MAINTAINS POSITIONAL RELATIONS BETWEEN SUPPLY ROLLER AND DEVELOPING ROLLER

[75] Inventor: Hiroshi Nakano, Nagoya, Japan

[73] Assignee: Brother Kogyo Kabushiki Kaisha, Nagoya, Japan

[21] Appl. No.: 863,184

[22] Filed: May 27, 1997

[30] Foreign Application Priority Data

May 27, 1996 [JP] Japan ..... 8-131477

[51] Int. Cl.[6] ..... G03G 21/00

[52] U.S. Cl. ..... 399/258; 399/111

[58] Field of Search ..... 399/258, 111, 399/119, 262, 113

[56] References Cited

U.S. PATENT DOCUMENTS

| | | | |
|---|---|---|---|
| 3,942,474 | 3/1976 | Smith et al. | 399/119 |
| 4,102,585 | 7/1978 | Hebenar | 399/361 |
| 4,194,850 | 3/1980 | Cranmore | 403/361 |
| 5,708,922 | 1/1998 | Azuma et al. | 399/111 |

FOREIGN PATENT DOCUMENTS

| | | |
|---|---|---|
| 61-290457 | 12/1986 | Japan . |
| 62-280866 | 12/1987 | Japan . |
| 7-295457 | 11/1995 | Japan . |
| 3-7969 | 1/1996 | Japan . |

*Primary Examiner*—Arthur T. Grimley
*Assistant Examiner*—Quana Grainger
*Attorney, Agent, or Firm*—Oliff & Berridge, PLC

[57] ABSTRACT

A toner supplying device is constructed such that, at each side of a pair of supporting plates 39 rotatably about a rotating center C, a toner supply roller 20, an upper and lower auger rollers 35 and 34, and a developing roller 19 are integrally supported, and each supporting plate 39 is made rotatable about a supporting shaft 1*e* whereby to allow the developing roller 19 to come into contact with a photosensitive drum 12. Accordingly, the toner supply roller 20 and the developing roller 19 can integrally be provided as maintaining a proper positional relation therebetween. With such a simple and inexpensive structure, the developing roller 19 is allowed to come into contact with the photosensitive drum 12, thereby enabling development using toner on an electrostatic latent image.

16 Claims, 7 Drawing Sheets

PRIOR ART

TONER SUPPLYING DEVICE FOR USE IN IMAGE FORMING APPARATUS THAT MAINTAINS POSITIONAL RELATIONS BETWEEN SUPPLY ROLLER AND DEVELOPING ROLLER

BACKGROUND OF THE INVENTION

1. Field of the Invention

The present invention relates to a toner supplying device for use in an image forming apparatus such as a laser printer, etc., for developing an electrostatic latent image by supplying toner to the electrostatic latent image formed on an outer peripheral surface of a photosensitive drum and transferring the image developed on the surface of the photosensitive drum onto a sheet, and particularly to a toner supplying device for use in an image forming apparatus, capable of assembling a toner supply roller, a developing roller, and other main components into a single unit while maintaining their positional mutual relation properly by supporting those toner supply roller, developing roller, and others with a pair of rotatable supporting plates, providing a simple structure, and thereby enabling to achieve development using toner on an electrostatic latent image by making the developing roller come into contact with a photosensitive drum.

2. Description of Related Art

Regarding conventional toner supplying devices for use in image forming apparatuses such as laser printers, etc., there have been proposed various types of the devices, which are in general constructed of a toner storing member including a toner cartridge for storing therein toner, a toner supply roller for supplying toner from the toner storing member, and a developing roller for supplying the toner provided from the toner supply roller onto an electrostatic latent image on a photosensitive drum to develop the image with toner. One embodiment of the toner supplying device will be explained with reference to FIG. 7. FIG. 7 is an explanatory view showing schematically a main construction of the toner supplying device in the prior art.

In FIG. 7, the toner supplying device has a toner cartridge 100 which accommodates therein toner and is provided with an opening for toner supply at an almost center in its width direction. This toner cartridge 100 is provided therein with an agitator 103 for agitating toner to supply same into a developing chamber 102 side through a toner supply port 101. A frame F of the toner supplying device is provided with an opening for toner supply positioned correspondingly to the toner supply opening of the toner cartridge 100. Those openings of the toner cartridge 100 and the frame F form the toner supply port 101 in combination with each other. Inside the developing chamber 102 constructed of an upper frame F1 and a lower frame F2 of the frame F, a toner supply roller 104 is arranged rotatably in a lower frame F2 side, for supplying the toner supplied through the toner supply port 101 to a developing roller 105.

Furthermore, on an internal wall of the upper frame F1, above the developing roller 105, a blade 107 is fixedly secured with a fixing element 106, whereby to regulate a thickness of the toner layer supplied on the surface of the developing roller 105. This developing roller 105 is also arranged in contact with a photosensitive drum 108. On the peripheral surface of the photosensitive drum 108 is formed an electrostatic latent image by an image exposure device not shown which performs a scanning operation with a laser beam in accordance with image data. The developing roller 105 supplies toner to the electrostatic latent image formed on the peripheral surface of the photosensitive drum 108 to develop the image. The image developed on the surface of the photosensitive drum 108 is then transferred onto a sheet fed from a sheet feeder not shown, forming a resultant image (a visual image) thereon.

In the above toner supplying device, the toner supply roller 104, the developing roller 105, and the blade 107 are integrally provided in a frame F formed of the upper and lower frames F1 and F2, thereby forming a unit (first unit). The developing roller 105 is made to come into contact with a photosensitive drum 108 as the whole unit is biased in the right direction in FIG. 7 by means of a biasing means such as a spring and the like. The unit including the toner supply roller 104 and other components is further integrally assembled with the photosensitive drum 108 by using another unit (second unit). Accordingly, the conventional toner supplying device needs two units.

In a manufacturing process to manufacture the above conventional image forming apparatus, as shown in FIG. 7, the first unit comprising therein the toner supply roller 104 and others is assembled with the photosensitive drum 108 by being biased by means of the biasing means so that the developing roller 105 comes into contact with the photosensitive drum 108. After that, the image forming apparatus in such an assembled state is forwarded as a good. The developing roller 105 in the assembled apparatus is, therefore, constantly in contact with the photosensitive drum 108.

The toner supply roller 104 is supported on side walls of the first unit so as to be rotatable. In detail, for a supporting structure, used is a general one in which end portions of a roller shaft of the toner supply roller 104 are inserted in recesses formed in the side walls of the first unit.

Meanwhile, in the toner supplying device in the prior art, as mentioned above, adopted is a structure such that the unit integrally constructed of the toner supply roller 104, the developing roller 105, and other components is biased toward the photosensitive drum 108 by means of the biasing means such as a spring and the like, thereby making the developing roller 105 come into contact with the photosensitive drum 108. Using the structure, no adjustment is needed after the positional relation between the toner supply roller 104 and the developing roller 105 is determined in the unit, and the biasing of the whole unit can prevent the occurrence of toner leakage from the toner cartridge 100.

However, a biasing means having a large biasing power is required to bias the whole first unit comprising therein the toner supply roller 104 and other components, and a second unit is also needed to integrally assemble the first unit with the photosensitive drum 108. As a result, it causes inevitably the increase in cost of the toner supplying apparatus.

In the conventional toner supplying device, furthermore, the developing roller 105 and the photosensitive drum 108 are in contact with each other at the completion of assembly. They stay in such a contacting state after the assembly of the toner supplying device until when it is actually used. At this time, provided is no means for releasing the contacting state of the developing roller 105 and the photosensitive drum 108. Therefore, the contacting state may cause problems such that the perpetual deformation of the developing roller 105 and the dirt of the photosensitive drum 108.

A structure in which end portions of a roller shaft of the roller 104 are inserted in the recesses formed in side walls of the unit is used for rotatably supporting the toner supply roller 104. A distortion may be produced between the end portions of the roller shaft and the recesses. The distortion between the roller shaft end portions and the recesses may increase of the torque to the toner supply roller 104 which may make it difficult to uniformly and smoothly supply toner to the developing roller 105.

SUMMARY OF THE INVENTION

The present invention has been made in view of the above circumstances and has an object to overcome the above problems and to provide a toner supplying device for use in an image forming apparatus, capable of constructing main components such as a toner supply roller, a developing roller and others into a unit as maintaining a proper positional relation between those main components by supporting them with a pair of supporting plates which can rotate, and of performing a toner development operation on an electrostatic latent image by making the developing roller come into contact with a photosensitive drum by means of the above simple structure, which is low in cost.

Another object of the present invention is to provide a toner supplying device capable of separating a developing roller from a photosensitive drum when necessary, thereby preventing the developing roller from being permanently deformed and the photosensitive drum from being dirtied and damaged.

Further object of the present invention is to provide a toner supplying device capable of preventing the occurrence of distortion between a spherical end portion and a bearing portion of a supporting plate by forming an end portion of a roller shaft of the toner supply roller into a spherical shape, thus of appropriately supplying toner from the toner supply roller to the developing roller.

Still further object of the present invention is to provide a toner supplying device capable of making a developing roller evenly come into contact with a photosensitive drum by means of a simple structure such that a train of gears is provided to a supporting plate so as to allow the rotational moment generating in the developing roller not to act as the rotating force making the supporting plate rotate, thus capable of performing a development operation with toner without unevenness in toner density.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a toner supplying device for use in an image forming apparatus in claim 1 of this invention, for developing an electrostatic latent image formed on an outer peripheral surface of a photosensitive drum by supplying toner to the image, and then transferring the developed image onto a sheet to form a resultant image, the toner supplying device comprising a toner storing member, a toner supply roller for supplying toner transported from the toner storing member, a developing roller for supplying the toner supplied from the toner supply roller to the electrostatic latent image formed on the surface of the photosensitive drum to develop the image, and a pair of supporting plates for supporting the toner supply roller and the developing roller at both sides of the rollers, the supporting plates being disposed rotatably so that the developing roller is allowed to come into contact with the photosensitive drum.

According to the above toner supplying device, the toner supply roller and the developing roller are supported at both sides thereof with a pair of rotatable supporting plates, and the developing roller is made to contact with the photosensitive drum according to the turning of the supporting plates, so that the toner supply roller and the developing roller can be assembled integrally into a unit as maintaining a proper positional relation with each other, and a development operation of the electrostatic latent image can be achieved by making the developing roller come into contact with the photosensitive drum by means of a simple structure, which is also low in cost.

The toner supplying device of claim 2 is characterized in that, in the developing device of claim 1, it further comprises a blade member for regulating a thickness of a toner layer supplied on the developing roller while staying in contact with the developing roller, the blade member being secured on each of the supporting plates.

Furthermore, the developing device according to claim 3 is characterized in that, in the developing device of claim 2, the blade member is extended along a length direction of the developing roller.

The developing device according to claim 4 is characterized in that, in the developing device of claim 1, it further comprises a biasing member for biasing the supporting plates toward the photosensitive drum, thereby to make the developing roller come into contact with the photosensitive drum by a biasing power of the biasing member.

The developing device according to claim 5 is characterized in that, in the developing device of claim 4, it further comprises a unit case for housing therein the toner supply roller, the developing roller, and the photosensitive drum which are supported with each of the supporting plates, holes formed in both side wall of the unit case close to each of the supporting plates, and separating members which are insertable into the holes, wherein a side portion in each of the separating members comes into contact with an end portion of the supporting plate when the separating members are inserted into the holes to separate the developing roller from the photosensitive drum against the biasing power of the biasing member.

The developing device according to claim 6 is characterized in that, in the developing device of claim 5, the separating member has a wedged shape so as to easily be inserted in the hole.

The developing device according to claim 7 is characterized in that, in the developing device of claim 1, the toner supply roller is provided with a roller member on a periphery of a roller shaft, an end portion of the roller shaft being formed into a spherical shape and supported in a bearing recess formed in the supporting plate.

The developing device according to claim 8 is characterized in that, in the developing device of claim 4, it further comprises a train of gears for driving the developing roller to rotate, the train of gears being rotatably supported by one of the supporting plates so that a rotational moment which generates when the developing roller is driven to rotate may not act as rotating force making the supporting plate rotate.

The developing device according to claim 9 is characterized in that, in the developing device of claim 8, each supporting plate has a rotating center at a lower position thereof and a cutout portion at an upper position thereof.

The developing device according to claim 10 is characterized in that, in the developing device of claim 9, it further comprises a unit case for housing therein the toner supply roller, the developing roller, and the photosensitive drum which are supported with each of the supporting plates, wherein the biasing member comprises a spring which is arranged between the cutout portion of the supporting plate and the unit case.

The developing device according to claim 11 is characterized in that, in the developing device of claim 10, the train of gears includes at least a first driven gear fixed to a roller shaft of the developing roller and a second driven gear meshed with the first driven gear.

The developing device according to claim 12 is characterized in that, in the developing device of claim 11, the first driven gear has a first rotating center and a first rotational moment to rotate the supporting plate toward the photosensitive drum generates based on positional relation between the rotating center of the supporting plate and the first rotating center.

The developing device according to claim 13 is characterized in that, in the developing device of claim 12, the second driven gear has a second rotating center and a second rotational moment to rotate the supporting plate opposite to the photosensitive drum generates based on positional relation between the rotating center of the supporting plate and the second rotating center.

The developing device according to claim 14 is characterized in that, in the developing device of claim 13, both the first rotational moment and the second rotational moment act to an one end of the spring, the one end contacting with the unit case.

The developing device according to claim 15 is characterized in that, in the developing device of claim 13, the rotating force for rotating the supporting plate is determined based on the rotational moment obtained by summing the first rotational moment and the second rotational moment.

The developing device according to claim 16 is characterized in that, in the developing device of claim 8, the rotating force making the supporting plate rotate based on the rotational moment generating in the train of gears is determined in the range of tolerance of the biasing power of the biasing member.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

A detailed description of a preferred embodiment of a toner supplying device for use in an image forming apparatus, specifically in a laser printer, embodying the present invention will now be given referring to the accompanying drawings.

Figure 1:
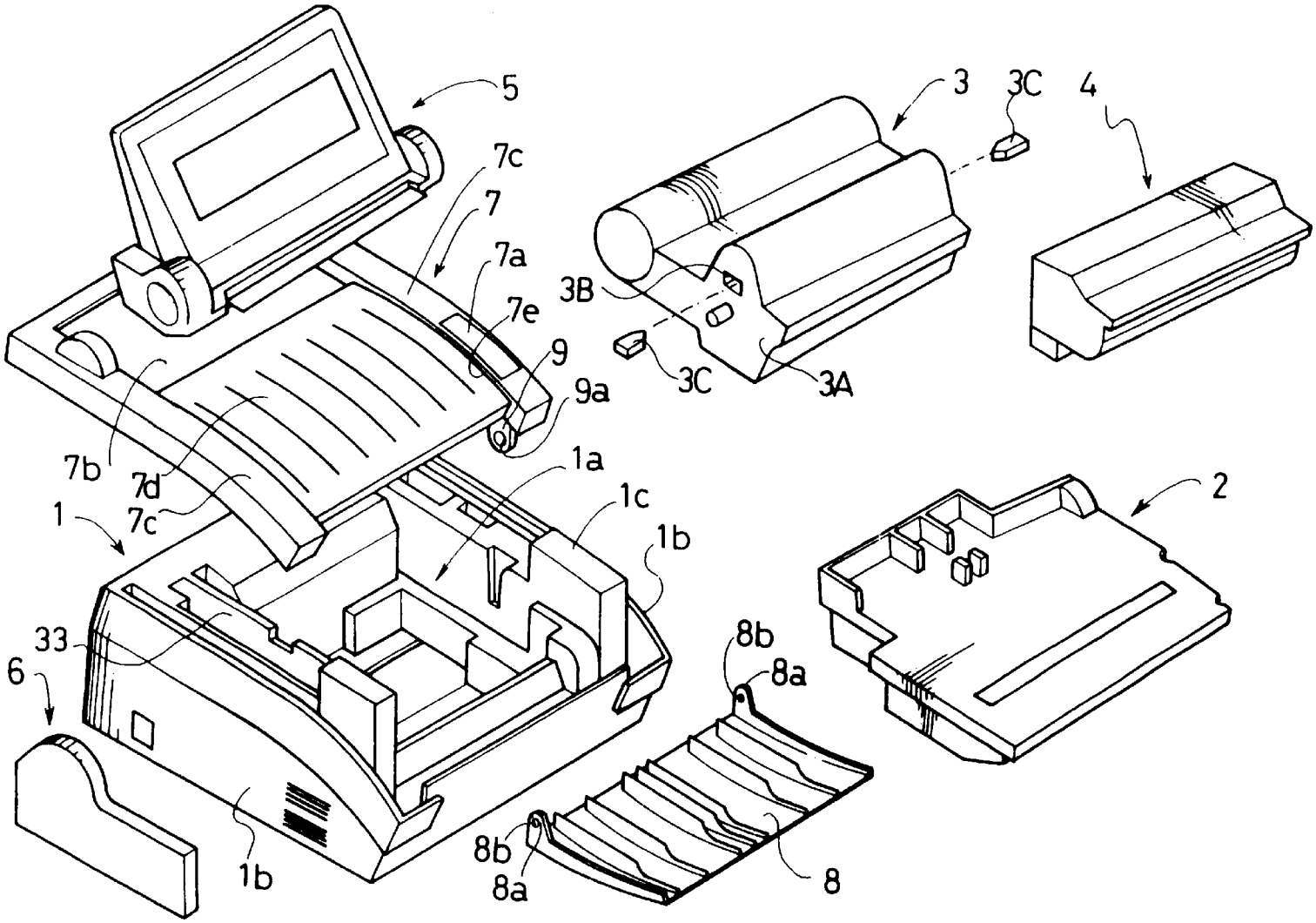
FIG. 1 is a perspective exploded view of main components of a laser printer in an embodiment according to the present invention.
Figure 2:
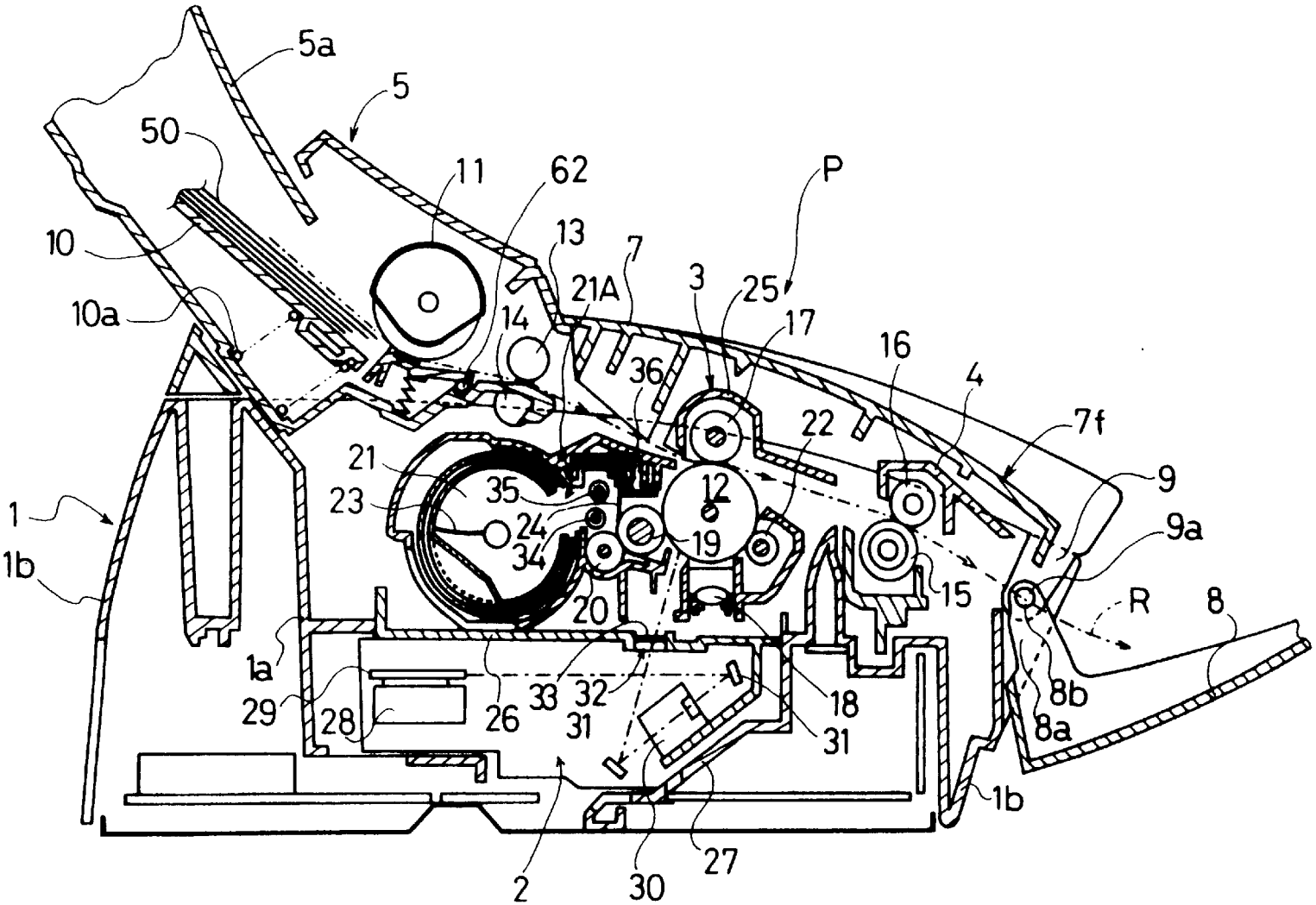
FIG. 2 is a sectional side view of the laser printer of FIG. 1.

First, schematic construction of a laser printer P in the present embodiment will be described with reference to FIGS. 1 and 2. FIG. 1 is a perspective exploded view of a main construction of the laser printer P. FIG. 2 is a sectional side view of the laser printer P.

In FIG. 1, a main housing 1 of the laser printer P is formed integrally of a main frame la and a main cover 1*b* by, for example, an injection molding process. In the main unit 1*a*, set are a scanner unit 2, a process unit 3, a fixing unit 4, and a sheet supply unit 5 from above the main unit 1*a*. The main cover 1*b* serves to cover the outer peripheral four side surfaces, i.e., a front, back, right, and left sides, of the main frame 1*a*. In a holding recess 33 defined by the outer surface of the main frame 1*a* and the inner surface of the main cover 1*b*, a driving system unit 6 including a driving motor and a train of gears is installed and fixed from the lower side of the main housing 1.

The process unit 3 is provided with holes 3B formed in a pair of side walls 3A (only one is shown in FIG. 1). In each of the holes 3B, a wedged member 3C can be inserted. This wedged member 3C functions as a separating member to separate a developing roller 19 and a photosensitive drum 12 from each other when necessary as mentioned later. When the wedged members 3C are inserted in the holes 3B, each side portion of the wedged members 3c comes into contact with each end portion of the supporting plates 39, making the developing roller 19 separate from the photosensitive drum 12 against the biasing power of a spring 40 (see FIG. 3).

The main frame 1a is provided an operational panel 1*c* formed extruding upward. Both upper surfaces of the main frame 1*a* and the main cover 1*b* are covered with an upper cover 7. This upper cover 7 is provided with a hole 7*a* through which the operational panel 1*c* can be inserted and an opening 7*b* through which a base part of the sheet supply unit 5 can be inserted. At both sides in a front side of the upper cover 7 (a right side in FIG. 1), a pair of brackets 9 each having a support shaft 9*a* extruding opposite to each other (only one of them is shown in FIG. 1). A sheet discharge tray 8 is provided with support portions 8*a* formed at both end sides thereof and bores 8*b* formed in the support portions 8*a*. Each of the bores 8*b* can be fitted to each support shaft 9*a* of the brackets 9 so that the sheet discharge tray 8 is supported rotatably with respect to the upper cover 7. On the upper surface of the upper cover 7, there are provided step portions 7*e* between the upper surfaces of side parts 7*c* and the upper surface of a center part 7*d*. Such the step portions 7*e* form a holding recess 7*f* as shown in FIG. 2 for holding the sheet discharge tray 8 in the center part 7*d* of the upper cover 7 during non-use of the tray 8. The sheet discharge tray 8 in non-use can be held in the holding recess 7*f* by turning about the support portions 8*a* to a position where it is held in the upper cover 7 and, to the contrary, it can be set for use at a position to stack the sheets discharged from the fixing unit 4 by turning contrariwise from the held position to a stack position shown in FIG. 2.

Next, the schematic internal structure of the laser printer P will more detail be explained referring to FIG. 2. In FIG. 2, sheets 50 are held as stacked in a feeder case 5*a* of the sheet supply unit 5. The tip end of each sheet 50 is pressed against a sheet supply roller 11 by a supporting plate 10 provided with a biasing spring 10*a*, disposed inside the feeder case 5*a*. The sheet supply roller 11 is driven to rotate by a driving power transmitted from the driving system unit 6 and transport individual sheets from the feeder case 5*a* in cooperation with a sheet separating member 62. The sheet 50 individually separated from the sheet stack is transported to the process unit 3 by means of a pair of resist rollers 13 and 14.

The process unit 3 is a unit to perform toner development of electrostatic latent image by supplying toner to the electrostatic latent image formed on the peripheral surface of the photosensitive drum 12 by means of a laser optical system which will be mentioned later, provided in the scanner unit 2 in accordance with image data. More specifically, the process unit 3 is constructed of the photosensitive drum 12, a transfer roller 17 disposed above the photosensitive drum 12 and in contact therewith, a charger 18 such as a Scorotron type of charger, disposed under the photosensitive drum 12, a developing unit including a developing roller 19 disposed upstream of the photosensitive drum 12 in a sheet feeding direction and a toner supply roller 20, a toner cartridge 21 attachably and detachably disposed upstream of the developing unit, which serves as a toner storing unit, and a cleaning roller 22 disposed downstream of the photosensitive drum 12, and other components.

Figure 5:
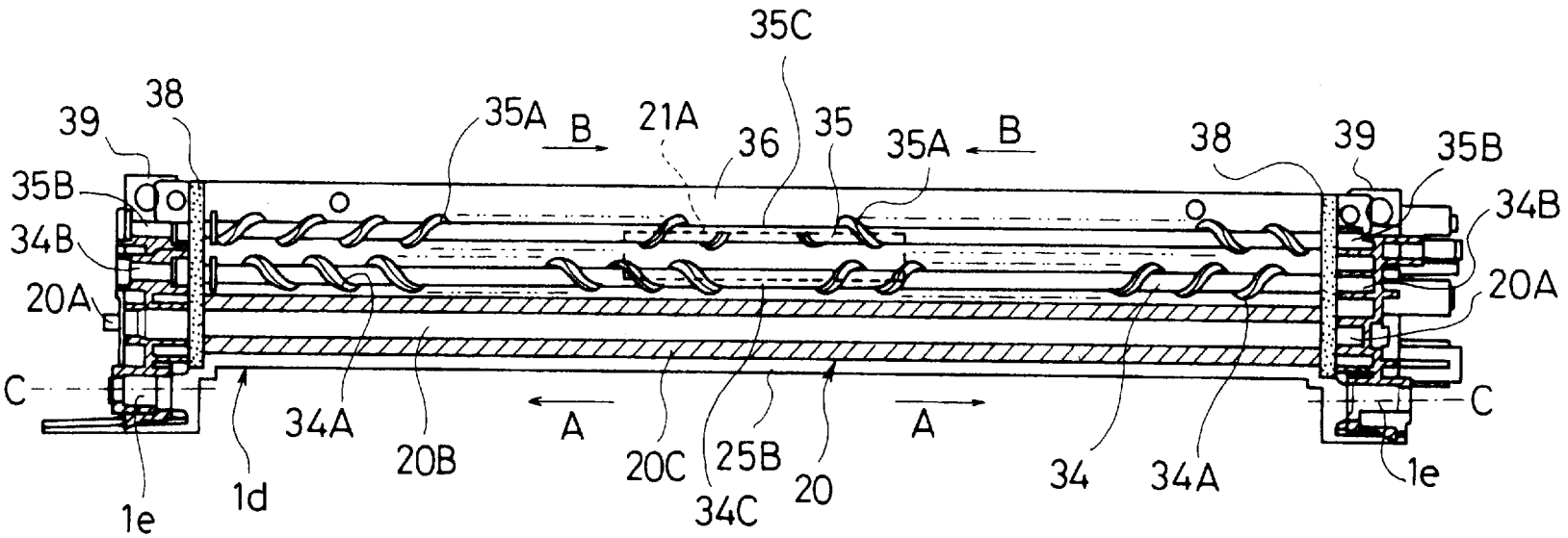
FIG. 5 is a sectional front view showing the internal construction of a developing chamber in the embodiment.

Inside of a developing chamber of the developing unit, a pair of auger rollers, namely, a lower auger roller 34 and an upper auger roller 35, are rotatably provided above the toner supply roller 20, between the supporting plates 39 (see FIG. 5). This lower auger roller 34 functions to transport the toner that is supplied from the toner cartridge 21 via a toner supply port 21A into the developing chamber, toward both sides of the toner supply roller 20 above the toner supply roller 20. The toner supply port 21A is constructed of an opening formed in the toner cartridge at an almost center position thereof and an opening formed in a unit frame 25. The upper auger roller 35 functions to transport the toner from the both sides of the toner supply roller 20 toward the toner supply port 21A. In this way, the toner is supplied from the toner supply port 21A to the developing chamber side by means of the upper and lower auger rollers 35 and 34, thereby to circulate above the toner supply roller 20 in the both sides thereof. While circulating, the toner is supplied to and stuck on the toner supply roller 20. The detail structure of each of the lower auger roller 34 and the upper auger roller 35 will be described later.

Figure 3:
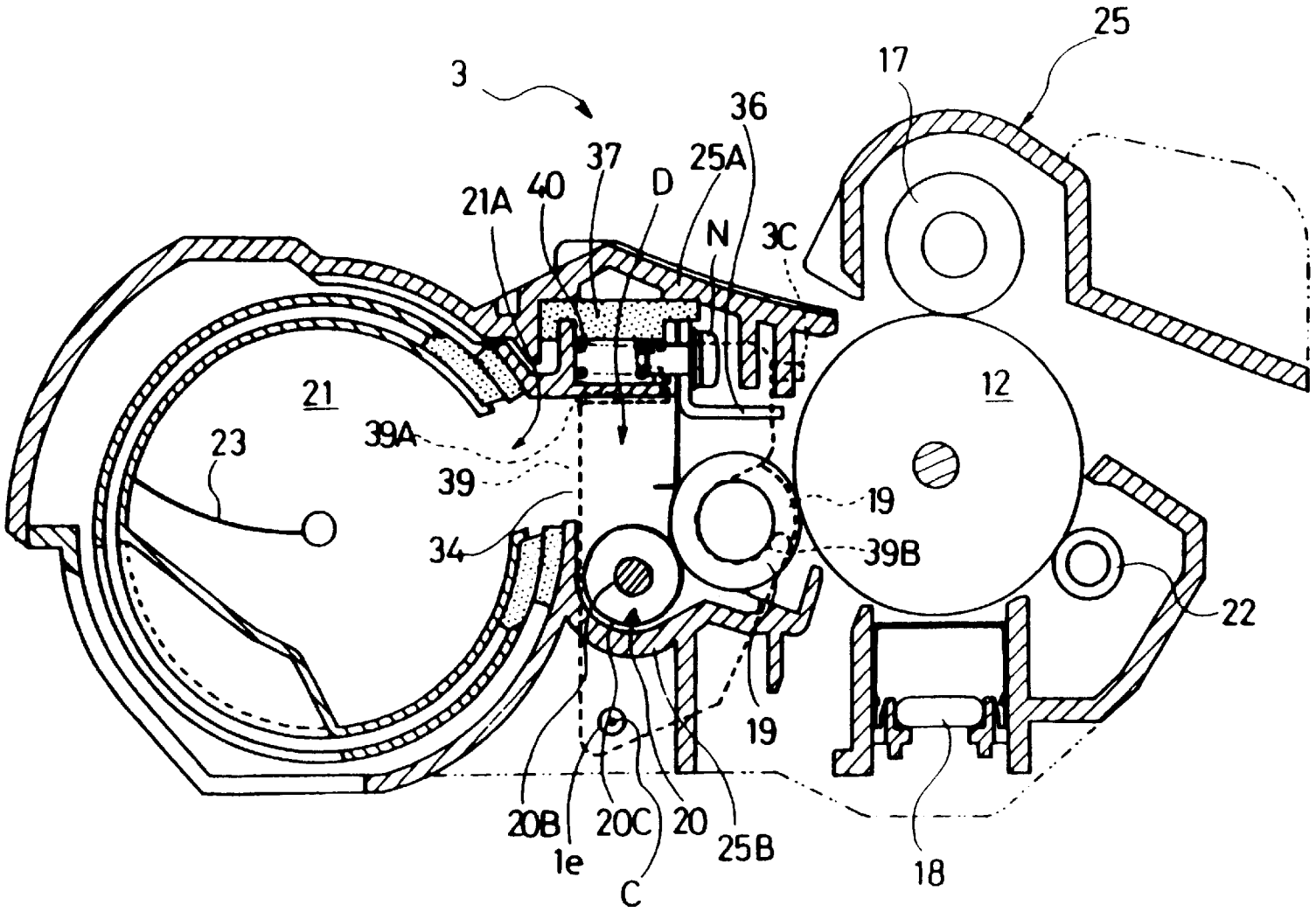
FIG. 3 is a sectional side view of a process unit of the laser printer of FIG. 1.

Above the developing roller 19, an L-shaped blade fixing element 36 is disposed between the supporting plates 39, whereby a blade 24 is secured with a fastening screw N (see FIG. 3). The blade fixing element 36 and the blade 24 are formed along a width of the laser printer P (in a perpendicular direction to a paper of FIG. 2). The blade 24 serves to regulate the thickness of a layer of toner supplied on the developing roller 19 from the toner supply roller 20 into a predetermined thickness.

On the outer peripheral surface of the photosensitive drum 12, an electrically charged layer is formed by the charger 18 and, then, an electrostatic latent image is formed thereon by scanning with a laser beam by means of the scanner unit 2. The toner stored in the toner cartridge 21 is stirred by an agitator 23 thereby to discharge the toner through the toner supply port 21A toward the developing chamber, and is held on the outer peripheral surface of the developing roller 19 via the toner supply roller 20, where the toner on the developing roller 19 is regulated to form a toner layer having a predetermined thickness by means of the blade 24. When the toner is transported from the developing roller 19 to and supplied on the photosensitive drum 12, the electrostatic latent image formed on the photosensitive drum 12 is visualized and transferred to the sheet 50 in passing between the transfer roller 17 and the photosensitive drum 12. The residual toner remaining on the photosensitive drum 12 is transported to the cleaning roller 22.

The process unit 3 constructed above is made as a cartridge type by assembling main components into the unit frame 25 formed of synthetic resin. This cartridge-type process unit 3 is detachably mounted in the main frame 1*a*.

The scanner unit 2 is provided with a well known laser optical system and makes a scanning on the photosensitive drum 12 by the laser optical system in accordance with predetermined image data, thereby forming an electrostatic latent image on the photosensitive drum 12. More specifically, the scanner unit 2 is arranged under the process unit 3 and a scanner cover 26 is attached on the upper surface of the scanner unit 3. This scanner cover 26 is fixed at the upstream side of a bottom plate 27 of the main frame 1*a*, covering substantially the whole opening of the main frame 1*a*, and is provided an oblong scanner hole 32 extending along the axis line of the photosensitive drum 12. The scanner unit 2 serving as an exposure unit is provided with a laser emitting element 28, a polygon mirror 29, a lens 30, and a reflecting mirror 31, in which a laser beam is allowed to pass through a glass plate 33 inserted in the oblong scanner hole 32 formed in the scanner cover 26 and is emitted to the outer peripheral surface of the photosensitive drum 12 in the process unit 3. Accordingly, the electrostatic latent image is exposed on the outer peripheral surface of the photosensitive drum 12 in accordance with the image data. To the electrostatic latent image formed on the photosensitive drum 12 by the laser optical system of the scanner unit 2 in the above way, the toner is supplied through the process unit 3 to develop the electrostatic latent image.

The developed image based on the electrostatic latent image formed on the photosensitive drum 12 in the process unit 3 is transferred onto the sheet 50 fed to the process unit 3. After that, the sheet 50 is transported to the fixing unit 4 where the toner image transferred onto the sheet 50 is subjected to a heat fixing process by means of a pair of a heat roller 15 and a pressure roller 16. The sheet 50 on which a resultant image (a visual image) is formed is then discharged by the rollers 15 and 16 and stacked onto the sheet discharge tray 8 disposed at a stack position. A path along which the sheet 50 is transported from the sheet supply unit 5 to the sheet discharge tray 8 is indicated by a two-dot chain line R in FIG. 2.

Next, the detail structure of the developing chamber in the process unit 3 will be described with reference to FIG. 3 through FIG. 5 hereinafter. FIG. 3 is a sectional side view of the process unit 3, FIG. 4 is a schematic explanatory view of a supporting structure to support the toner supply roller 20 and the developing roller 19 with the supporting plates, and FIG. 5 is a sectional front view showing the internal structure of a developing chamber in the embodiment.

The developing chamber D is a space defined by an upper seal member 37 disposed at a lower surface of an upper frame 25A of the unit frame 25, a lower frame 25B of the unit frame 25, and a pair of side seal members 38 shown in FIG. 5 formed of a sponge material, disposed at both sides inside the developing chamber D. The toner supply roller 20 is constructed of a main shaft 20B provided at its both ends with end shafts 20A, and a roller member 20C formed of a sponge material covering the main shaft 20B in its overall length. Each of the end shafts 20A is inserted in a hole of the side seal member 38 and supported at its outer side with each of the supporting plates 39 attached rotatably to the lower frame 25B (see FIGS. 3 and 4).

Meanwhile, the supporting plates 39 will be explained with reference to FIG. 3 and FIG. 5. Each of the supporting plates 39 is rotatably supported in a supporting shaft 1*e* formed in a lower frame 1*d* of the main housing 1, the rotating center (axis) of each supporting plate 39 is indicated by an alphabet C in FIG. 3 and FIG. 5. As shown in FIG. 3, the supporting plate 39 is provided with a cutout 39A at a left upper part in the drawing and a supporting portion 39B at a right lower part. A spring 40 is disposed in the cutout 39A, whereby each supporting plate 39 is biased in a clockwise direction in FIG. 3 about the rotating center C. The developing roller 19 is rotatably supported by the supporting portions 39B, and is made to come into contact with a surface of the photosensitive drum 12 as the supporting plates 39 are made to rotate clockwise by a biasing power of the spring 40. This biased state is shown by a solid line in FIG. 3. When the wedged members 3C are inserted in the holes 3B in the side walls 3A of the process unit 3, each side portion of the wedged members 3C comes into contact with each end portion of the supporting plates 39. The supporting plates 39 are made to rotate counterclockwise against the biasing power of the spring 40, thus separating from the photosensitive drum 12. This separating state is shown by a dotted line in FIG. 3.

Figure 4A:
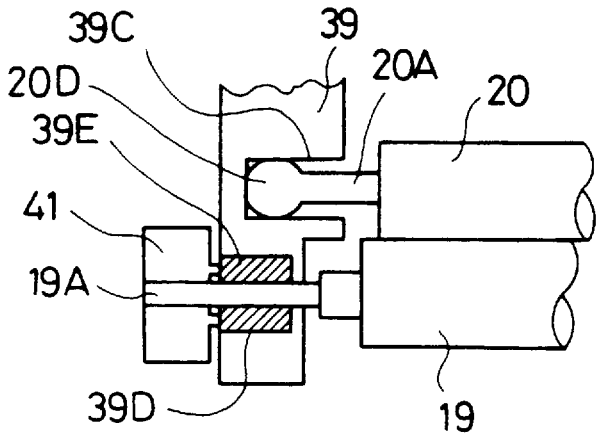
FIGS. 4 (A) and (B) are schematic explanatory views of a supporting structure for supporting a toner supply roller and a developing roller with supporting plates.

Next, the supporting structure to support the toner supply roller 20 and the developing roller 19 with the supporting plates 39 will be explained with reference to FIGS. 4 (A) and (B). FIGS. 4 (A) and (B) show only a supporting structure of one supporting plate 39, whereas another supporting plate 39 is provided with the same supporting structure. As shown in FIG. 4(A), an end portion of the end shaft 20A of the toner supply roller 20 is formed into a spherical shape (spherical end portion 20D), and the supporting plate 39 is provided with a bearing recess 39C for supporting therein the spherical end portion 20D. The supporting plate 39 is also provided with a bearing hole 39D in which a bearing 39E is fitted. In this bearing 39E is inserted a roller shaft 19A of the developing roller 19. At an end of the roller shaft 19A of the developing roller 19, a driven gear 41 constructing a train of gears which will be mentioned later is fixedly mounted.

Figure 4B:
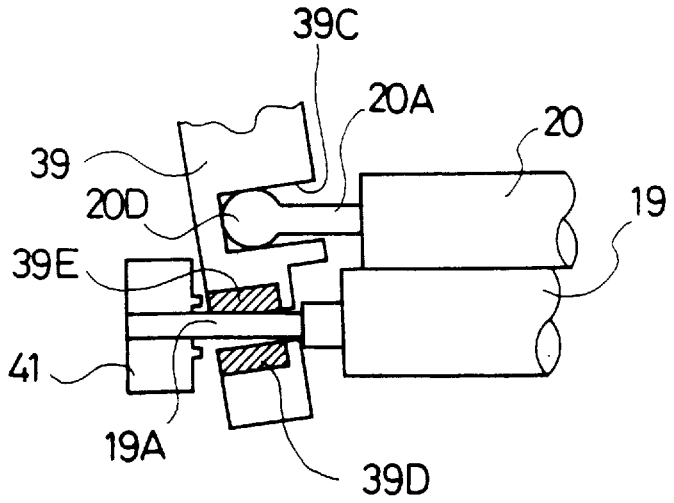

With the above supporting structure in which the end portion of the end shaft 20A is formed into the spherical end portion 20D, the spherical end portion 20D can be rotated freely and smoothly inside the bearing recess 39C when the toner supply roller 20 is driven to rotate as supported with the supporting plates 39. This makes it possible to prevent the occurrence of distortion between the spherical end portion 20D and the bearing recess 39C of the supporting plate 39 even when the supporting plate 39 inclines as shown in FIG. 4(B). It is therefore possible to supply toner from the toner supply roller 20 to the developing roller 19 without causing the increase of torque to the toner supply roller 20.

As shown in FIG. 5, furthermore, the lower auger roller 34 in which a center portion 34C thereof is substantially correspondent to a position where the toner supply port 21A is formed (corresponding to a center portion of the toner supply port 21A), is provided with spiral teeth 34A formed spirally extending from the center portion 34C toward opposite ends of the auger roller 34 on the outer surface thereof. A roller shaft 34B of the auger roller 34 is supported at both ends thereof with the supporting plates 39 as well as the toner supply roller 20 is. When the lower auger roller 34 is rotated clockwise in FIG. 3, accordingly, the toner supplied from the toner supply port 21A is transported successively along the spiral teeth 34A above the toner supply roller 20 toward both ends of the developing chamber D in opposite directions indicated by arrows A. Similarly, a center portion 35C of the upper auger roller 35 is substantially correspondent to a position where the toner supply port 21A is formed (corresponding to a center portion of the toner supply port 21A). The upper auger roller 35 is provided with spiral teeth 35A formed spirally extending from both ends of the auger roller 35 toward the center portion 35C. A roller shaft 35B of the auger roller 35 is supported with the supporting plates 39 as well as the upper auger roller 34 is. When the upper auger roller 35 is rotated clockwise in FIG. 3 and the toner transported by the lower auger roller 34 toward the both ends of the developing chamber D is so increased to reach the upper auger roller 35, the toner is transported successively along the spiral teeth 35A in directions indicated by arrows B toward the toner supply port 21A. Thus, a part of the toner is returned to the toner cartridge 21 through the toner supply port 21A. In this way, the toner not used for image development is circulated as above and returned to the toner cartridge 21, so that it can prevent toner from remaining in the developing chamber D for a long time. This makes it possible to supply constantly fresh toner from the toner cartridge 21. Even if the toner is not returned to the toner cartridge 21, stirring and circulating by the upper and lower auger rollers 35 and 34 makes toner smoothly flow in the developing chamber D without causing agglomeration of toner.

As mentioned above, the toner supply roller 20, the upper and lower auger rollers 35 and 34, and the developing roller 19 are integrally supported with the supporting plates 39, and the supporting plates 39 are constructed rotatably about the supporting shaft 1*e*, thereby to make the developing roller 19 come into contact with the photosensitive drum 12, so that the toner supply roller 20 and the developing roller 19 can be integrally constructed into a unit as maintaining a proper positional relation therebetween, and thus a development operation using toner on an electrostatic latent image can be performed by making the developing roller 19 come into contact with the photosensitive drum 12 by means of the simple structure as above, which is also low in cost. In addition to the toner supply roller 20 and the developing roller 19, the upper and lower auger rollers 35 and 34 and the blade 24 are supported with the supporting plates 39, forming an integral unit, so that the positional relation between those components can easily be adjusted in the unit and the maintenance of the toner supplying device can be made simply. The positional relation between the blade 24 and the developing roller 19 can also be maintained properly at all times.

The developing roller 19 is made to come into contact with the photosensitive drum 12, as described above, as the supporting plates 39 are biased clockwise by the biasing power of the spring 40. For the spring 40, any spring is usable if it has the biasing power sufficient to bias the supporting plates 39. The spring 40 having a small biasing power can be used accordingly. With the spring 40, the developing roller 19 can accurately contact the photosensitive drum 12.

On the other hand, the insertion of the wedged members 3C into the holes 3B makes the developing roller 19 separate from the photosensitive drum 12 against the biasing power of the spring 40. Thus, the developing roller 19 and the photosensitive drum 12 can be separated when necessary, so that it is possible to prevent the permanent deformation of the developing roller 19 and also the dirt and damage of the photosensitive drum 20 caused by the contact with the developing roller 19.

Each of the upper and lower auger rollers 35 and 34 serves to transport and circulate the toner supplied from the toner supply port 21A into the developing chamber D, above the toner supply roller 20, thereby enabling uniform supplying of toner to all the toner supply roller 20 over without allowing the toner to remain in a limited part. As toner is transported and circulated above the toner supply roller 20 and in its both side directions by means of the upper and lower auger rollers 35 and 34, constantly fresh toner can be supplied on all over the toner supply roller 20, making it possible to supply uniformly toner to the developing roller 19 and the electrostatic latent image formed on the outer peripheral surface of the photosensitive drum 12, thereby to form for a long time the resultant image excellent in quality.

As above, the forming position of the toner supply port 21A in the toner cartridge 21 (a center position of the toner supply port 21A) substantially coincides with the center positions 35C and 34C of the upper and lower auger rollers 35 and 34, so that the toner discharged through the toner supply port 21A can efficiently be transported and circulated above the toner supply roller 20 via the upper and lower auger rollers 35 and 34.

Figure 6:
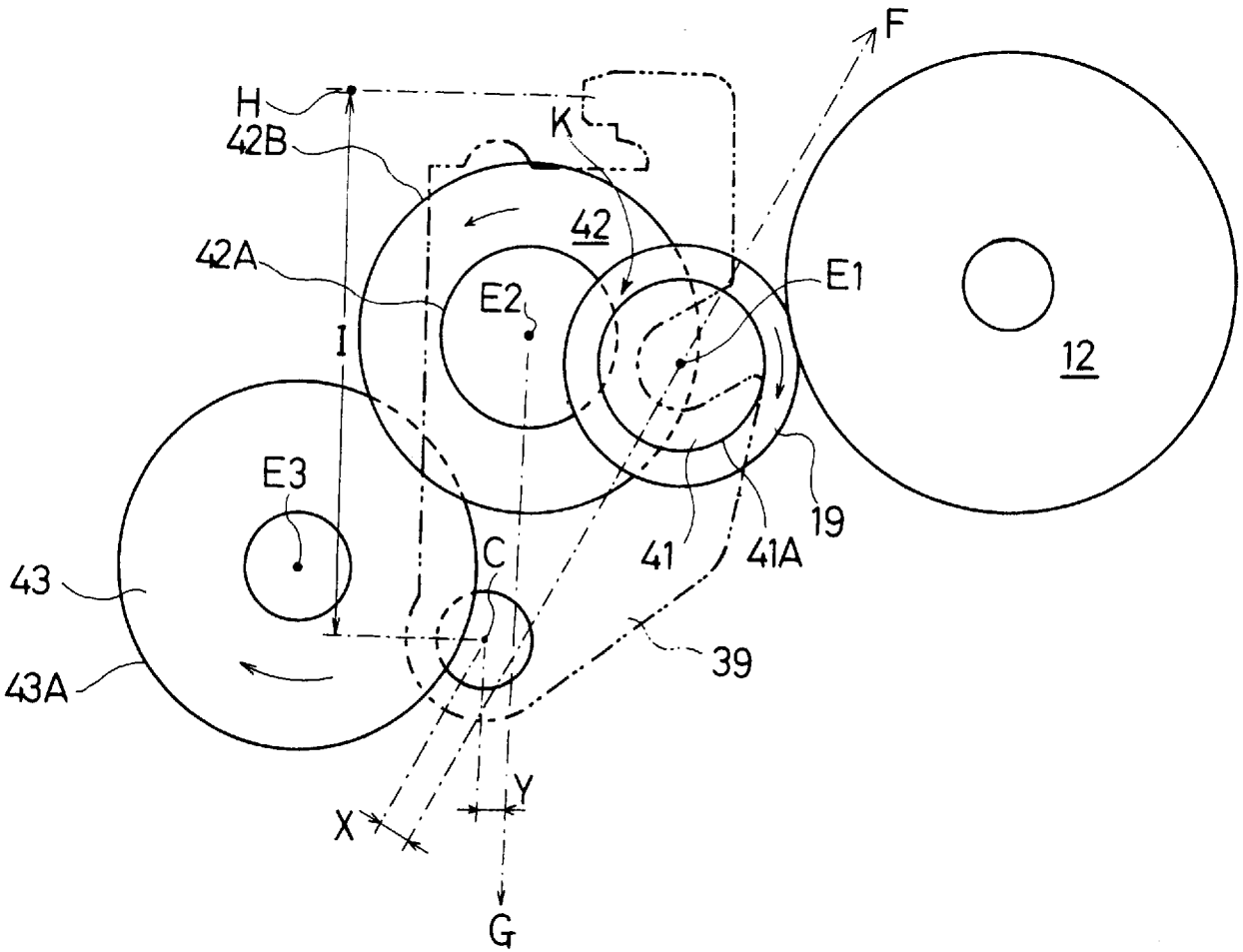
FIG. 6 is a schematic explanatory view of a train of gears disposed with respect to the supporting plate.
Figure 7:
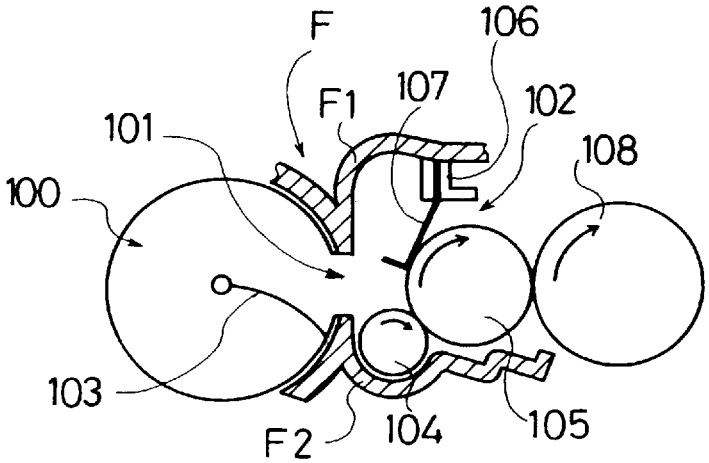
FIG. 7 is an explanatory view schematically showing a main part of a toner supplying device in the prior art.

A structure of a train of gears provided to the supporting plate 39 to rotate the developing roller 19 is next explained, referring to FIG. 6. FIG. 6 is a schematic explanatory view of the train of gears.

In FIG. 6, the driven gear 41 is fixedly mounted to the roller shaft 19*a* (see FIG. 4) of the developing roller 19 and is provided with gear teeth 41A. This driven gear 41 is driven to rotate clockwise together with the developing roller 19. When the driven gear 41 is rotated clockwise, the rotating force acts in a direction F and produces the rotational moment causing the supporting plate 39 to rotate counterclockwise, based on a distance X determined between the rotating center (axis) C of the supporting plate 39 and rotating center (axis) E1 of the driven gear 41 as shown in FIG. 6. Among the rotating force operating on the supporting plate 39, the rotating force acting in a clockwise direction is herein regarded as a "Positive" for the sake of convenience.

To the supporting plate 39, also rotatably provided is a driven gear 42 provided with gear teeth 42A engaged with the gear teeth 41A of the driven gear 41 and gear teeth 42B on the outer peripheral surface of the gear 42. This driven gear 42 is made to rotate counterclockwise about the rotating center E2. When the driven gear 42 is driven to rotate counterclockwise in the drawing, the rotating force acts in a direction G and produces the rotational moment causing the supporting plate 39 to rotate clockwise, based on a distance Y determined between the rotating center C of the supporting plate 39 and the rotating center E2 of the driven gear 42. The rotating force acting in a counterclockwise direction is herein regarded as a "Negative" for the sake of convenience. Those driven gears 41 and 42 construct a train of gears K.

Furthermore, a driven gear 43 is disposed out of the supporting plate 39. This driven gear 43 is provided with gear teeth 43A which are engaged with the gear teeth 42B of the driven gear 42, and is driven to rotate clockwise about a rotating center E3 by means of a driving motor not shown.

Both of the rotational moment causing the supporting plate 39 to rotate counterclockwise according to the rotation of the driven gear 41 and the rotational moment causing the same to rotate clockwise according to the rotation of the driven gear 42 act upon an action point H corresponding to a back end portion (a left end in FIG. 3) of the spring 40. A distance between the action point H and the rotating center C of the supporting plate 39 is indicated by an alphabet I in FIG. 6.

In the above structure, when the driven gear 43 is driven to rotate in a clockwise direction, the driven gear 42 is rotated counterclockwise through the gear teeth 43A and the gear teeth 42B. At this time, the rotating force making the supporting plate 39 rotate based on the rotation of the driven gear 42 acts in the direction G, then the rotational moment making the supporting plate 39 rotate clockwise about the rotating center C generates based on the distance Y between the rotating center E2 and the rotating center C. It was actually observed in the case shown in FIG. 6 that the rotating force acting in the direction G was 2,756 gf and the distance Y was 0.19 cm, for instance. Accordingly, the rotational moment becomes 523.5 gfcm based on 2,756 gf×0.19 cm.

As the driven gear 42 is made to rotate counterclockwise as above, the driven gear 41 is rotated clockwise through the gear teeth 42A and the gear teeth 41A. At this time, the rotating force making the supporting plate 39 turn based on the rotation of the driven gear 41 acts in the direction F, then the rotational moment causing the supporting plate 39 to rotate counterclockwise about the rotating center C generates based on the distance X between the rotating center E1 and the rotating center C. It was actually observed in the case shown in FIG. 6 that the rotating force acting in the direction F was 2,540 gf and the distance X was 0.23 cm, for instance. Accordingly, the rotational moment becomes −576.6 gfcm based on −2,540 gf×0.23 cm. Here, the rotating force is regarded as a "Negative" because the rotating force acts on the supporting plate 39 to rotate counterclockwise.

Based on the above point, the rotating force acting upon the point of action H can be calculated by adding up both values of the rotational moment calculated above and then by dividing the added value by a distance I between the point of action H and the rotating center C. The distance was actually observed as 3.646 cm. Concretely, it is calculated by the expression: (523.5 gfcm−576.6 gfcm)/3.646 cm, and the calculated value thereof is −14.5 gf. According to this value, the rotating force making the supporting plate 39 as a whole rotate counterclockwise will act in the case that the train of gears K is provided to the supporting plate 39. The biasing power of the spring 40, the back end portion of which the action point H is correspondent to, is set to about 250 g in the present embodiment. If considering the biasing power of the spring 40, the value (−14.5 gf) of the rotating force calculated as above is equal to about 5% of the biasing power of the spring 40.

On the other hand, it is general that tolerance of usually ±10% is included in the biasing power by taking unevenness in products and the like into account. Accordingly, it is found that the value (−14.5 gf) of the rotating force is set within the tolerance of the spring 40. If the train of gears K is provided to the supporting plate 39 as mentioned above, the rotational moment which generates through the train of gears K when the developing roller 19 is driven to rotate will not substantially act as the rotating force making the supporting plate 39 rotate.

Consequently, the supporting plates 39 are biased in a clockwise direction by only the biasing power of the spring 40, so that the developing roller 19 is made to come into contact with the photosensitive drum 12. It is accordingly possible to perform uniform development with toner on the electrostatic latent image without unevenness in toner density. The rotating force generating through the train of gears K at the time of the rotation of the developing roller 19 is set within the tolerance of the biasing power of the spring 40, so that the rotating force based on the rotational moment generating in the train of gears K can be absorbed in the range of the biasing power of the spring 40. This makes it possible to allow the developing roller 19 to come into contact uniformly with the photosensitive drum 12, thereby enabling to uniformly perform a development operation with toner without unevenness in toner density.

As mentioned above, the toner supplying device in the present embodiment is constructed so that the toner supply roller 20, the upper and lower auger rollers 35 and 34, and the developing roller 19 are integrally supported at both sides of those rollers with a pair of the supporting plates which is rotatable about the rotating center C, and also the developing roller 19 can be made to come into contact with the photosensitive drum 12 in accordance with the rotation of the supporting plates 39 rotatable about the supporting shaft 1*e*. Accordingly, with a simple and inexpensive structure as above in which the toner supply roller 20 and the developing roller 19 are integrally arranged while properly keeping the positional relation therebetween, development using toner on an electrostatic latent image can be conducted by making the developing roller 19 come into contact with the photosensitive drum 12.

In addition of the toner supply roller 20 and the developing roller 19, the upper and lower auger rollers 35 and 34 and the blade 24 are supported with the supporting plates 39, so that the adjustment of the positional relation between those components can easily be made in a unit and the maintenance thereof can also simply be conducted. Furthermore, the positional relation between the blade 24 and the developing roller 19 can be maintained properly at all times.

Since the developing roller 19 is made to come into contact with the photosensitive drum 12 as the spring 40 biases the supporting plates 39 in a clockwise direction, any spring is usable for the spring 40 if it has the biasing power sufficient to bias the supporting plates 39. The spring 40 having a small biasing power can be used accordingly. With the spring 40, the developing roller 19 can accurately contact the photosensitive drum 12,.

When the wedged members 3C are inserted into the holes 3B, the side portions of the wedged members 3C come into contact with the end portions of the supporting plates 39, separating the developing roller 19 from the photosensitive drum 12 against the biasing power of the spring 40. Thus, the developing roller 19 and the photosensitive drum 12 can be separated when necessary, so that it is possible to prevent the permanent deformation of the developing roller 19 and also the dirt and damage of the photosensitive drum 20 caused by the contact with the developing roller 19.

To rotatably support the toner supply roller 20 with the supporting plates 39, the end portions of the end shafts 20A of the toner supply roller 20 are formed into the spherical end portions 20D, so that there occur no distortion between the spherical end portions 20D and the bearing recesses 39C of the supporting plates 39, making it possible to supply toner appropriately from the toner supply roller 20 to the developing roller 19.

Further, the train of gears K is attached to the supporting plate 39 so that, the rotational moment generating in the developing roller 19 when driven to rotate via the train of gears K may not act as the rotating force making the supporting plate 39 rotate. The supporting plate 39 is therefore biased in a clockwise direction by the biasing power of the spring 40. Accordingly, the developing roller 19 can stay in uniformly contact with the photosensitive drum 12, so that a development operation can be achieved with uniform toner density.

Since the rotating force generating through the train of gears K by the rotation of the developing roller 19 is set within the tolerance of the biasing power of the spring 40, the rotating force based on the rotational moment generating in the train of gears K can be absorbed in the range of the biasing power of the spring 40. It is consequently possible to allow the developing roller 19 to come into contact uniformly with the photosensitive drum 12, resulting in a uniform development with toner on the electrostatic latent image.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner supplying device for use in an image forming apparatus, for developing an electrostatic latent image formed on an outer peripheral surface of a photosensitive drum by supplying toner to the image, and then transferring the developed image onto a sheet to form a resultant image, the toner supplying device comprising:

a toner storing member;

a toner supply roller for supplying toner transported from the toner storing member;

a developing roller for supplying the toner supplied from the toner supply roller to the electrostatic latent image formed on the surface of the photosensitive drum to develop the image;

a unit case for housing therein the toner storing member, the toner supply roller, the developing roller and the photosensitive drum, the unit case being fixedly set in the image forming apparatus; and a pair of supporting plates for supporting the toner supply roller and the developing roller at both sides of the rollers, the supporting plates being disposed rotatably in the unit case so that the supporting plates rotate independently from the unit case and so that the developing roller is allowed to come into contact with the photosensitive drum.

2. A toner supplying device according to claim 1, further comprising a blade member for regulating a thickness of a toner layer supplied on the developing roller while staying in contact with the developing roller, the blade member being secured on each of the supporting plates.

3. A toner supplying device according to claim 2, wherein the blade member is extended along a length direction of the developing roller.

4. A toner supplying device according to claim 1, further comprising a biasing member for biasing the supporting plates toward the photosensitive drum, thereby to make the developing roller come into contact with the photosensitive drum by a biasing power of the biasing member.

5. A toner supplying device according to claim 4, further comprising:

holes formed in both side walls of the unit case close to each of the supporting plates; and separating members which are insertable into the holes;

wherein a side portion in each of the separating members comes into contact with an end portion of the supporting plate when the separating members are inserted into the holes to separate the developing roller from the photosensitive drum against the biasing power of the biasing member.

6. A toner supplying device according to claim 5, wherein the separating member has a wedged shape so as to easily be inserted in the hole.

7. A toner supplying device according to claim 4, further comprising a train of gears for driving the developing roller to rotate, the train of gears being rotatably supported by one of the supporting plates so that a rotational moment which is generated when the developing roller is driven to rotate may not act as rotating force making the supporting plate rotate.

8. A toner supplying device according to claim 7, wherein each supporting plate has a rotating center at a lower position thereof and a cutout portion at an upper position thereof.

9. A toner supplying device according to claim 8, wherein the biasing member comprises a spring which is arranged between the cutout portion of the supporting plate and the unit case.

10. A toner supplying device according to 9, wherein the train of gears includes at least a first driven gear fixed to a roller shaft of the developing roller and a second driven gear meshed with the first driven gear.

11. The toner supplying device according to claim 10, wherein the first driven gear has a first rotating center and a first rotational moment to rotate the supporting plate toward the photosensitive drum is generated based on positional relation between the rotating center of the supporting plate and the first rotating center.

12. A toner supplying device according to claim 11, wherein the second driven gear has a second rotating center and a second rotational moment to rotate the supporting plate opposite to the photosensitive drum is generated based on positional relation between the rotating center of the supporting plate and the second rotating center.

13. A toner supplying device according to claim 12, wherein both the first rotational moment and the second rotational moment act to one end of the spring, the one end contacting with the unit case.

14. A toner supplying device according to claim 12, wherein the rotating force for rotating the supporting plate is determined based on the rotational moment obtained by summing the first rotational moment and the second rotational moment.

15. A toner supplying device according to claim 7, wherein the rotating force making the supporting plate rotate based on the rotational moment generating in the train of gears is determined in the range of tolerance of the biasing power of the biasing member.

16. A toner supplying device according to claim 1, wherein said toner supply roller is provided with a roller member on a periphery of a roller shaft, an end portion of the roller shaft being formed into a spherical shape and supported in a bearing recess formed in the supporting plate.

* * * * *